US008286279B2

(12) United States Patent
Stimpson

(10) Patent No.: US 8,286,279 B2
(45) Date of Patent: Oct. 16, 2012

(54) PUMPED WASTE

(75) Inventor: Robert William Stimpson, British Isles (GB)

(73) Assignee: DLP Limited, Braddan (IM)

( * ) Notice: Subject to any disclaimer, the term of this patent is extended or adjusted under 35 U.S.C. 154(b) by 1528 days.

(21) Appl. No.: 11/792,423

(22) PCT Filed: Nov. 30, 2005

(86) PCT No.: PCT/GB2005/004561
§ 371 (c)(1),
(2), (4) Date: Jun. 6, 2007

(87) PCT Pub. No.: WO2006/061570
PCT Pub. Date: Jun. 15, 2006

(65) Prior Publication Data

US 2008/0209628 A1 Sep. 4, 2008

(30) Foreign Application Priority Data

Dec. 9, 2004 (GB) ..... 0426947.8

(51) Int. Cl.
*E03C 1/00* (2006.01)

(52) U.S. Cl. ..... 4/668

(58) Field of Classification Search ..... 4/668, 671–673, 4/679, 681–683, 688, 693, 287, 650
See application file for complete search history.

(56) References Cited

U.S. PATENT DOCUMENTS 5,324,171 A * 6/1994 Cook ..... 417/40
2003/0006245 A1 1/2003 Rodgers

FOREIGN PATENT DOCUMENTS

| | | | |
|---|---|---|---|
| EP | 0838668 | * | 4/1998 |
| GB | 2361419 | | 10/2001 |
| GB | 2361419 A | * | 10/2001 |
| JP | 1116122 A | * | 10/1987 |
| JP | 01116122 | | 5/1989 |
| JP | 02004141 | | 1/1990 |
| JP | 2003004511 | | 1/2003 |

* cited by examiner

*Primary Examiner* — Lori Baker
(74) *Attorney, Agent, or Firm* — Eitan Mehulal & Sadot

(57) ABSTRACT

A pumped waste (10) for a shower comprises a sump (12), a waste water inlet (14) through which waste water enters the sump (12), a waste water outlet (16) for connection to a pump for drawing at least a portion of the waste water from the sump (12) through the waste water outlet (16), and a switch device (24) for controlling the pump. The switch device (24) includes a first part (26) which is located on the sump (12), and a second part (28) which is provided externally of the sump (12) in spaced relationship with the first part (26). The second part (28) is spaced from, and positioned at a level below, the waste water inlet (14). The in use first and second parts (26, 28) of the switch device cooperate without physical contact with each other to control the pump based on the level of water in the waste.

12 Claims, 3 Drawing Sheets

PUMPED WASTE

RELATED APPLICATIONS

The present application is a US National Phase of PCT Application No. PCT/GB2005/004561, filed on Nov. 30, 2005, which claims the benefit under 35 U.S.C. 119(a) of UK Patent Application 0426947.8 filed on Dec. 9, 2004, the disclosures of which are incorporated herein by reference.

The present invention relates to a pumped waste, the definition of which includes a drain sump, for a shower and, more particularly but not exclusively, to a pumped waste which may be installed into a shower tray or base.

It is known from GB2361419A to provide a shower drain waste which has a sump or chamber, water waste inlets and outlets, and a pump which is in fluid communication with the outlet. A float switch is entirely accommodated within the sump or chamber, and the energisation of the pump is controlled based on the position of the float due to the level of water in the sump or chamber.

However, a significant problem associated with this arrangement is that the electrical connections to the contacts of the float switch are fully immersed or exposed to the waste water running into the waste, leading to potential safety and reliability issues.

A further problem is apparent in that it becomes complicated to discretely run wiring from the float switch to the pump, since the float switch is positioned completely within the waste, and any wiring must exit the sump which is located in the shower tray, presenting a trip hazard to the user and detracting from the overall appearance of the installation The present invention seeks to provide a solution to these problems.

According to the present invention, there is provided a pumped waste for a shower, the waste comprising a sump, a waste water inlet through which waste water enters the sump, a waste water outlet for connection to a pump for drawing at least a portion of the said waste water from the sump through the waste water outlet, and a switch device for controlling the pump, characterised in that the switch device includes a first part which is disposed within the waste and which is located on the sump, and a second part which is provided externally of the sump in spaced relationship with the first part, the second part being spaced from, and positioned at a level below, the waste water inlet, the in use first and second parts of the switch device cooperating without physical contact with each other to control the pump based on the level of water in the waste.

It is advantageous to be able to control the pump based on the water level within the waste, due to the undesirable noise associated with a continuously running pump. By providing the electrical means for controlling the pump externally of the sump, wiring can be safely and unobtrusively run to the pump.

Furthermore, this arrangement also provides considerable benefits to the electrical installation of the pumped waste by ensuring all electrical connections are below the shower tray, which is an area outside defined safety zones according to the UK IEE Wiring Regulations.

Preferable and/or optional features of the first aspect of the invention are set forth in claims 2 to 11, inclusive.

The invention will now be more particularly described, by way of example only, with reference to the accompanying drawings, in which.

Figure 1:
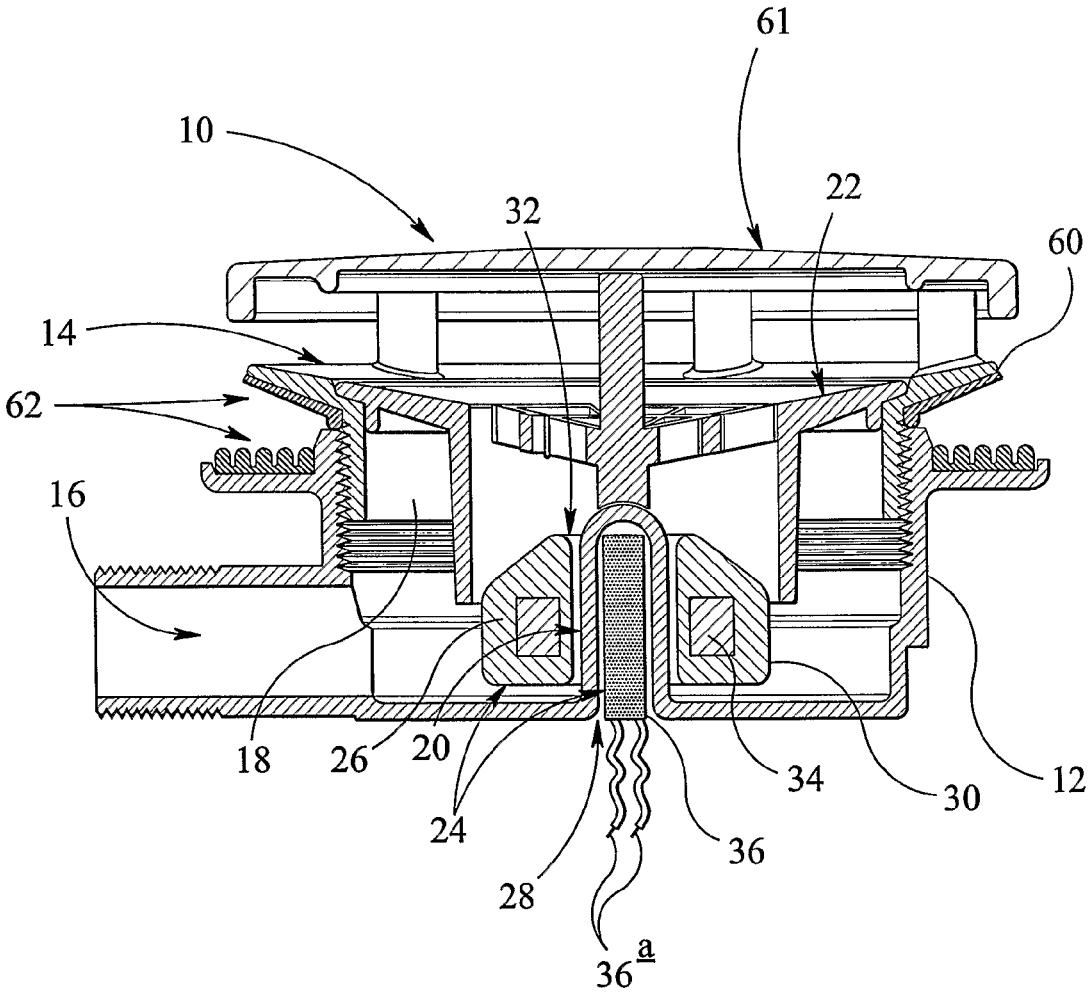
FIG. 1 is a diagrammatic side sectional view of a first embodiment of a pumped waste for a shower, in accordance with the invention.

Referring firstly to FIG. 1 of the drawings, there is shown a first embodiment of a pumped waste 10, which is typically injection moulded from plastics material. The waste 10 comprises a sump 12, a waste water inlet 14 leading into a well 18, a waste water outlet 16, and means for securing and sealing the waste 10 to a shower tray or base.

An electrically operated pump (not shown) is provided downstream of the waste 10 and, when in use, is in fluid communication with the waste water outlet 16.

The sump 12 defines a generally cylindrical interior chamber 18 with a hollow upstanding spigot 20 unitarily formed centrally therein.

The waste water outlet 16 is, typically integrally, formed in a side of the sump 12. The waste water outlet 16 is dimensioned to be engagable with a discharge pipe (not shown). The discharge pipe leads to the pump and may be flexible to aid installation.

The securing and sealing means is, typically, in the form of a threaded top clamp ring 60 which is threadably engageable with the sump 12 in conjunction with sealing elements 62 to retain the sump in the shower tray waste opening. This type of arrangement is well known, and thus will not be described in any further detail. However, suitable alternative means include the use of adhesive instead of, or in addition to, the clamp ring 60, or the incorporation of the sump into a mounting suitable for a wet-floor former type of shower base.

The pumped waste 10 further includes a removable cap 61 which is typically supported in spaced relationship by the clamp ring 60. The space between the cap and the clamp ring 60 thus defines the water inlet 14.

The cap is dimensioned to extend over or substantially over the opening to the sump 12.

An optional removable filter element 22 may be conveniently seated within the sump 12, below the cap 61. The filter element 22 is supported at its centre by the spigot 20, and is prevented from being removed by the cap 61 when it is in place.

A switch device 24 for controlling the pump is incorporated as part of the waste 10. The switch device 24 comprises a first part 26 which is located within the waste 10, and a second part 28 which is located externally of the sump 12.

The first part 26 includes a float element 30 having an aperture 32, and a magnetic element 34 housed in or mounted on the float element 30. The spigot 20 in the sump 12 is received in the aperture 32 of the float element 30, thereby allowing the float element 30 to slide up and down the spigot 20. The magnetic element 34 is typically annular and preferably in the form of a ring. However, the magnetic element 34 may be in the form of two or more discrete magnets spaced from each other.

The second part 28 comprises a reed switch 36 which is electrically connected via wires reed switch 36*a* to the pump. The reed switch 36 is located within the hollow spigot 20, on or adjacent to the exterior surface of the sump 12. In this manner, the first part 26 and the second part 28 of the switch device 24 are physically spaced from each other by having the wall of the sump 12 interposed therebetween.

By providing the reed switch 36 within or substantially within the spigot 20, flush mounting of the waste 10 on a supporting surface, for example a joist, is still possible.

The relative positioning of the reed switch 36 of the second part 28 and the magnetic element 34 of the first part 26 is such that, with the float element 30 on or adjacent to the bottom of the sump 12, in other words, with little or no water in the sump 12, the reed switch 36 is in a first, typically open, condition whereby the pump is not energised. However, as the float element 30 moves up the spigot 20 with the ingress of water into the sump 12, the magnetic element 34 becomes increasingly spaced from the reed switch 36. At a predetermined separation, the magnetic field will cease to affect the reed switch 36, and the reed switch 36 will move into a second, typically closed, condition whereby the pump becomes energised. When energised, the pump draws water from the sump 12 through the waste water outlet 16.

As the water level decreases in the sump 12, the float element 30 of the first part 26 moves down the spigot 20. The magnetic field of the magnetic element 34 again influences the reed switch 36, causing it to revert to its first condition and thus deenergise the pump. External control circuitry may be beneficially connected across the output connections leads to the switch device to delay the deenergising of the pump to smooth out irregularities in the flow of water out of the sump to the pump. This external control circuitry may be beneficially incorporated within the spigot 20 of the sump or alternatively, within the pump control unit itself.

Figure 2:
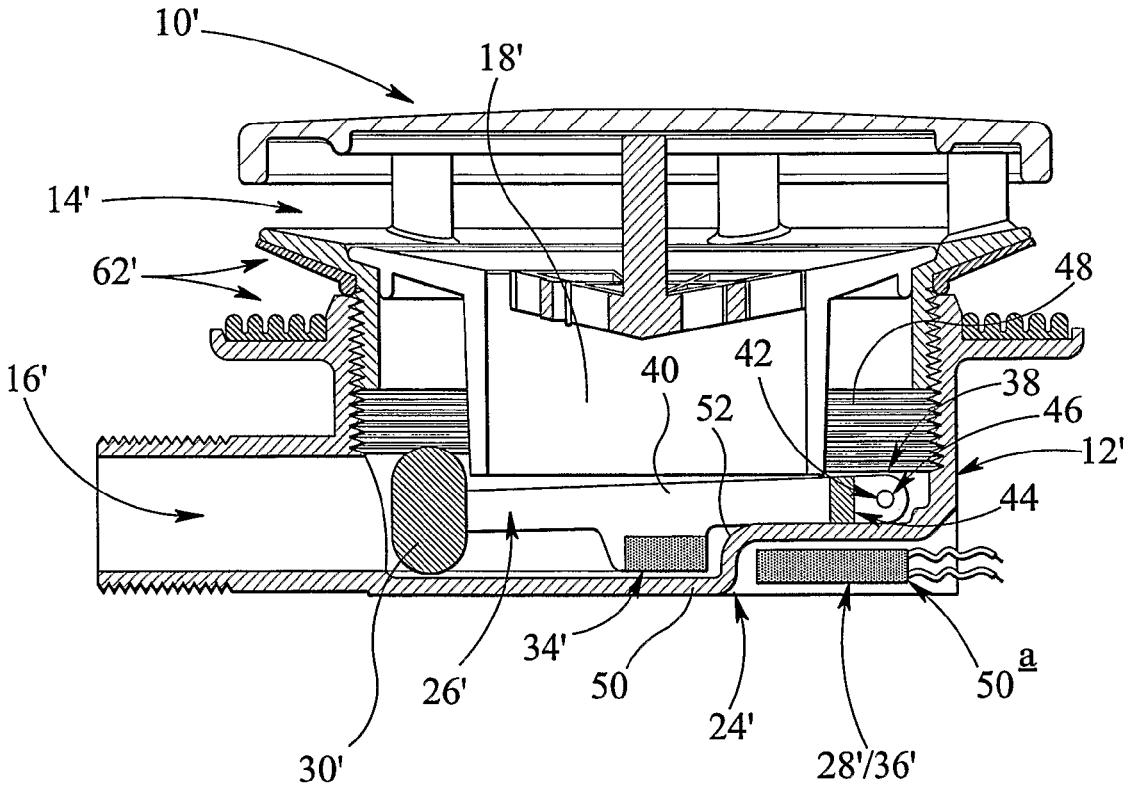
FIG. 2 is a diagrammatic side sectional view of a second embodiment of a pumped waste for a shower, in accordance with the invention.

Referring now to FIG. 2, a second embodiment of a pumped waste 10' is shown. Like references refer to like parts, and further description will be omitted.

The waste 10' is similar to the waste 10 of the first embodiment and comprises a sump 12', a waste water inlet 14' leading into the sump 12', a waste water outlet 16', securing means 62' for sealing the waste 10' into a shower tray, and a switch device 24' for controlling an electrically operable pump. The securing means is, to all intents and purposes, the same as described with respect to the first embodiment.

The spigot 20 of the first embodiment is dispensed with.

The first part 26' of the switch device 24' includes a float element 30', magnetic element 34', and a pivot mechanism 38. The pivot mechanism 38 has a float arm 40 and a pivot 42. The arm 40 may be a simple linear device linking the pivot 42 and float element 30', or it may alternatively be a circular or toroidal device linking the pivot 42 and float element 30' such that the centre of the sump 12' remains unobstructed. The float arm 40 is connected to the float element 30' at one end and to the pivot 42 at the other end. The pivot 42 includes a spindle arm 44 which projects from the bottom or side of the sump 12' into chamber 18', a spindle 46 which projects transversely from the spindle arm 44, and an aperture 48 or recess in the end of the float arm 40 into which at least part of the spindle 46 projects. The float arm 40 is thus angularly displaceable about the spindle 46.

The spindle arm 44 is either integrally formed as part of the sump 12', or is fastenable to the sump 12'.

A base 50 of the sump 12' includes a step 52. The float arm 40 of the first part 26' of the switch device 24', when resting, projects over the step 52. The magnetic element 34' is provided on the float arm 40 part way between the float element 30' and the spindle aperture 48. The magnetic element 34', when the float arm 40 is at rest, resides at the lower level of the base 50 adjacent to the step 52.

Second part 28' again comprises a reed switch 36' which is positioned externally of the sump 12'. In this case, the reed switch 36' is provided on or adjacent to the exterior surface of the sump 12', in a recess **50*a* formed by the step 52 in the base 50 of the sump 12'**.

This arrangement allows the magnetic element 34' of the first part 26' and the reed switch 36' of the second part 28' to come into close proximity to each other without the float element 30' and float arm 40 unduly obstructing the waste water outlet 16'.

By providing the step 52 in the base 50 of the sump 12', and thus the reed switch 36' in the inherently formed recess **50*a*, the waste 10'** can still be mounted flush to a supporting surface, such as a joist.

The pump is controlled in the same manner as described with reference to the first embodiment. As the water level rises, the float element 30' floats upwards until a position is reached whereby the magnetic field of the magnetic element 34' no longer influences the reed switch 36', at which point it adopts its second, typically closed, second condition and the pump is activated.

By providing the magnetic element 34' at a position part way between the ends of the float arm 40, and with the float element 30' at one end of the float arm 40, a mechanical advantage is obtained, allowing the magnetic element 34' to be moved more easily.

Figure 3:
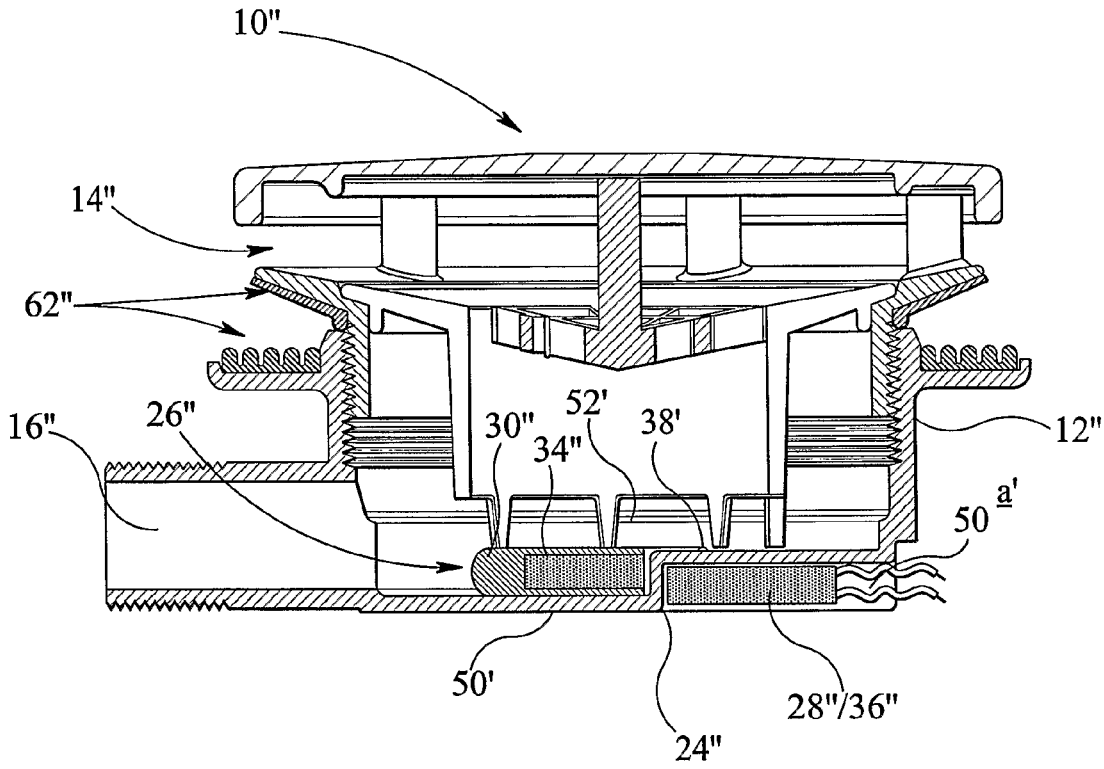
FIG. 3 is a diagrammatic side sectional view of a third embodiment of a pumped waste for a shower, in accordance with the invention.

Referring now to FIG. 3, a third embodiment of a pumped waste 10" is shown. Again, like references refer to like parts, and further description will be omitted.

The waste 10" is similar to the wastes 10 and 10', and comprises a sump 12", a waste water inlet 14" leading into the sump 12", a waste water outlet 16", securing means 60", 62" for sealing the waste 10" into a shower tray, and a switch device 24" for controlling an electrically operable pump. The securing means is, to all intents and purposes, the same as described with respect to the first embodiment.

A base 50' of the sump 12" includes a step 52', as with the second embodiment.

The first part 26" of the switch device 24" again includes a float element 30", magnetic element 34", and a pivot mechanism 38'. However, in this case, float arm 40' is shorter, the float element 30" is profiled to match or substantially match the depth of the step 52' in the bottom of the sump 12", and the magnetic element 34" is incorporated as part of the float element 30". Consequently, the float arm 40', when at rest, lies substantially flush with the upper level of the step 52'.

Second part 28" of the switch device 24" comprises a reed switch 36" which is positioned externally of the sump 12" in a recess **50*a'* inherently formed by the step 52' in the base 50' of the sump 12"**.

The low profile arrangement reduces the chance of an obstruction at the opening to the waste water outlet 16", and, due to the low profile, decreases the chance of the float arm 40' retaining detritus and other particulate matter thereon.

Again, by providing the step 52' in the base 50' of the sump 12', and thus the reed switch 36" in the inherently formed recess **50*a'*, the waste 10'** can still be mounted flush to a supporting surface, such as a joist.

The pump is controlled in the same manner as described with reference to the first embodiment. As the water level rises, the float element 30" floats upwards until a position is reached whereby the magnetic field of the magnetic element 34" no longer influences the reed switch 36", at which point it adopts its second, typically closed, condition and the pump is activated.

Although a reed switch is suggested in the above embodiments, a Hall Effect switch or other magnetically controlled switching element can be utilised instead. Alternatively, any other exterior switch can be used which can be remotely operated based on the level of water within the sump.

In a modification to the above embodiments, the first part of the switch device of the waste is or includes a field generating device which is incorporated within the waste, and the second part of the switch device is or includes a field sensitive control device which is provided externally of the sump and which can directly or indirectly control the pump.

The field generating device outputs a field based on the level of water within the waste, and is typically a metallic or electromagnetic device.

The field sensitive control device is a magnetic or capacitative device which controls the operation of the pump based on the field produced by the field generating device.

An example of such a field generating and detection configuration is the placement of a miniaturised version of an electromagnetic field signal sensor on one part and a moving element on the other part, of the type of field sensor with sensing elements of the type and method typically seen as anti-theft tags placed upon clothing in retail shops. This embodiment of a miniaturised variant of such a sensor would have a very small operating range, sufficient to detect the immediate adjacent presence or otherwise of the float portion of the device inside the waste. When liquid is present in the sump, the float moves one part of the field sensing device away from the base of the waste, thereby triggering a change of state in the other part. Control circuitry external to the waste and switch would then take this signal to control the pump connected to the waste. Other field sensing devices apparent to those skilled in the art will be seen to be applicable to this configuration of waste water level sensing floating device. Clearly the lighter in weight the sensing device embedded or attached to the floating element within the waste sump, the more sensitive the invention and the smaller the resulting float device to achieve the required movement of the activation component within the sump.

Yet another example of field would be the placement of an electric coil external to the waste sump, and to place a metal such as iron core suspended on the float arm so that it penetrated the coil. Movement of the float will move the metal core, so changing the inductance of the coil and external circuitry may then respond to this change and control the pump accordingly.

It is envisaged that the switch device described above can be provided as a kit of parts to retrofit on a suitable standard pumped shower waste. In this case, it is preferable that the existing pumped waste has the features, aside from the switch device, described with respect to at least one of the first to third embodiments. However, it is clearly possible from the preceding description, to consider a waste without the recess feature 50*a*, 50*a'*, 50*a*", where the sensing element and moving elements are placed on opposite sides of the lower flat or slightly sloping lower surface to the waste sump 12, 12', 12".

It is thus possible to control a waste water pump associated with a pumped waste by providing a discrete switch or control device externally of the sump and a discrete element within the waste which controls the switch or control device based on the level of water in the waste without a physical connection being required. By not exposing the electrical arrangement of the switch or control device to the waste water flowing into the waste, safety is inherently increased.

The embodiments described above are given by way of examples only, and further modifications will be apparent to persons skilled in the art without departing from the scope of the invention as defined by the appended claims.

The invention claimed is:

1. A pumped waste for a shower, the waste comprising:

a sump;

a waste water inlet through which waste water enters the sump;

a waste water outlet for connection to a pump for drawing at least a portion of the said waste water from the sump through the waste water outlet; and a switch device for controlling the pump, the switch device including:

a first part which is disposed within the waste and which is located on the sump; and a second part which is provided externally of the sump in spaced relationship with the first part, the second part being spaced from, and positioned at a level below, the waste water inlet, and being provided in a recess to allow flush mounting of the waste to a supporting surface, the in use first and second parts of the switch device cooperating without physical contact with each other to control the pump based on the level of water in the waste.

2. A pumped waste as claimed in claim 1, wherein the first part of the switch device includes a magnetic element.

3. A pumped waste as claimed in claim 2, wherein the first part of the switch device further includes a float element.

4. A pumped waste as claimed in claim 3, wherein the sump has a spigot along which the first part can move as the water level in the waste changes.

5. A pumped waste as claimed in claim 3, wherein the first part is pivotable relative to the second part.

6. A pumped waste as claimed in claim 1, wherein the second part is provided on or adjacent to the exterior surface of the sump.

7. A pumped waste as claimed in claim 1, wherein the second part is a Hall Effect switch.

8. A pumped waste as claimed in claim 1, wherein the second part is a reed switch.

9. A pumped waste as claimed in claim 1, wherein the first part of the switch device is or includes a field generating device which can output a field based on the level of water in the waste, and the second part is or includes a field sensitive device which controls the pump based on the field output by the field generating device.

10. A pumped waste as claimed in claim 9, wherein the field generating device is a metallic or electromagnetic device.

11. A pumped waste as claimed in claim 9, wherein the field sensitive device is a magnetic or capacitative device or an inductive device.

12. A pumped waste as claimed in claim 1, in combination with an electrically operated waste water pump.

* * * * *